US006792235B2

(12) United States Patent
Kubota et al.

(10) Patent No.: US 6,792,235 B2
(45) Date of Patent: Sep. 14, 2004

(54) ELECTROPHOTOGRAPHIC APPARATUS INCLUDING TRANSFERRING DEVICE

(75) Inventors: Keisuke Kubota, Ibaraki (JP); Masayoshi Ishii, Ibaraki (JP); Teruaki Mitsuya, Ibaraki (JP); Hideki Ando, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/189,624

(22) Filed: Jul. 8, 2002

(65) Prior Publication Data

US 2003/0063915 A1 Apr. 3, 2003

(30) Foreign Application Priority Data

Sep. 28, 2001 (JP) ..... P.2001-301390

(51) Int. Cl.[7] ..... G03G 15/16; G03G 15/00

(52) U.S. Cl. ..... 399/315; 399/44; 399/66; 399/311

(58) Field of Search ..... 399/43, 44, 45, 399/66, 311, 315

(56) References Cited

U.S. PATENT DOCUMENTS 4,286,862 A * 9/1981 Akita et al. ..... 399/315
5,029,314 A * 7/1991 Katsumi et al. ..... 399/44
6,337,968 B1 * 1/2002 Hayashida ..... 399/315

FOREIGN PATENT DOCUMENTS

| | | | |
|---|---|---|---|
| JP | 1-179180 A | * | 7/1989 |
| JP | 07-160125 | | 6/1995 |
| JP | 7-261564 A | * | 10/1995 |
| JP | 11-24417 A | * | 1/1999 |
| JP | 2001-83808 A | * | 3/2001 |
| JP | 2001-324897 A | * | 11/2001 |

* cited by examiner

*Primary Examiner*—Sandra L. Brase
(74) *Attorney, Agent, or Firm*—McGinn & Gibb, PLLC

(57) ABSTRACT

A transfer flow-in current which flows from a transferring device into an image carrier, a separation flow-in current which flows from a separating device into the image carrier, an aperture width in the recording member transporting direction of an aperture of the transferring device, and an aperture width in the recording member transporting direction of an aperture of the separating device are set so as to have the relationship: separation flow-in current=transfer flow-in current×(transfer aperture width/separation aperture width).

27 Claims, 5 Drawing Sheets

| TEMP. | HUMIDITY | | | | |
|---|---|---|---|---|---|
| | <20% | <40% | <60% | <80% | ≦100% |
| <10°C | 28 | 26 | 24 | 17 | 14 |
| <14°C | 23 | 21 | 19 | 13 | 10 |
| <18°C | 19 | 16 | 14 | 9 | 5 |
| <22°C | 13 | 11 | 10 | 5 | 2 |
| <26°C | 9 | 7 | 5 | 1 | -1 |
| <30°C | 4 | 2 | 0 | -3 | -6 |
| <34°C | 0 | -1 | -3 | -9 | -10 |
| <38°C | -3 | -4 | -6 | -12 | -13 |
| <42°C | -7 | -8 | -8 | -13 | -15 |
| <46°C | -9 | -10 | -10 | -14 | -16 |
| ≦50°C | -10 | -12 | -12 | -15 | -16 |

ELECTROPHOTOGRAPHIC APPARATUS INCLUDING TRANSFERRING DEVICE

BACKGROUND OF THE INVENTION

1. Field of the Invention

The present invention relates to an electrophotographic apparatus which forms an image on a recording member by using the electrophotographic process.

2. Description of the Related Art

In the electrophotographic process, it is known that a corona discharger comprising a corona discharge wire is used as transferring means for transferring a toner image formed on an image carrier such as a photosensitive member to a recording member such as a paper sheet.

A transfer corona discharger (hereinafter, referred to as "a transferring device") supplies charges of a polarity opposite to that of a toner, to the rear face of a recording member, i.e., the face opposite to the face to which a toner image is to be transferred, thereby transferring the toner image on the image carrier onto the recording member.

The recording member which has received the toner image from the image carrier must be then transported to a fixing device so that the toner image is fixed to the recording member. However, it is often that, after the transferring step, the recording member is caused by the influence of an electrostatic force not to be successfully separated from the image carrier, with the result that the recording member is wound around the image carrier.

In order to prevent such a failure of separation of a recording member from an image carrier from occurring, a countermeasure is usually taken on an electrophotographic apparatus of this kind in the following manner. A separation corona discharger (hereinafter, referred to as "a separating device") is disposed in a stage subsequent to the transferring device. When, for example, positive charges are supplied from the transferring device to the rear face of a recording member, the separating device supplies negative charges to the rear face of the recording member to neutralize electrostatic charges on the recording member, so that the recording member can be smoothly transported toward the fixing device without being wound around the image carrier.

However, it is known that the flow-in currents to a recording member from the transferring device and the separating device are varied depending on the kind and ream weight of a recording member which is used in printing, or environmental conditions (the percentage of water absorption of the recording member, the environment at the periphery of a corona discharge wire, and the like). Under given preset conditions, it is difficult to realize stable transfer/sepration.

For example, Japanese Patent Laid-Open No. 160125/1995 proposes a configuration in which the temperature and humidity at the periphery of a corona discharge wire of a separating device are detected, and the discharge voltage of the corona discharge wire of the separating device is changed on the basis of a result of the detection, thereby realizing stable transportation of a recording member.

In the configuration disclosed in Japanese Patent Laid-Open No. 160125/1995, a countermeasure against deterioration with age of a corona discharge wire is not taken, and hence further room remains for improvement.

SUMMARY OF THE INVENTION

It is an object of the invention to provide an electrophotographic apparatus in which, irrespective of deterioration of a corona discharge wire, stable separation and transportation of a recording member can be realized for a long term.

The object is realized by an electrophotographic apparatus comprising: a transferring device which is configured by a corona discharger comprising: a shielding section that has an aperture in a part; and a corona discharge wire that is supported by the shielding section, the transferring device transferring a toner image formed on an image carrier to a recording member; and a separating device which is configured by a corona discharger comprising: a shielding section that has an aperture in a part; and a corona discharge wire that is supported by the shielding section, the separating device being disposed downstream in a recording member transporting direction from the transferring device, and releasing charges of a polarity opposite to a polarity of charges released from the transferring device, wherein a transfer flow-in current which flows from the transferring device into the image carrier, a separation flow-in current which flows from the separating device into the image carrier, an aperture width in the recording member transporting direction of the aperture of the transferring device, and an aperture width in the recording member transporting direction of the aperture of the separating device are set to have a following relationship: separation flow-in current= transfer flow-in current×(transfer aperture width/separation aperture width).

DETAILED DESCRIPTION OF THE PREFERRED EMBODIMENTS

Now, a description will be given in more detail of preferred embodiments of the invention with reference to the accompanying drawings.

(First Embodiment)

Figure 1:
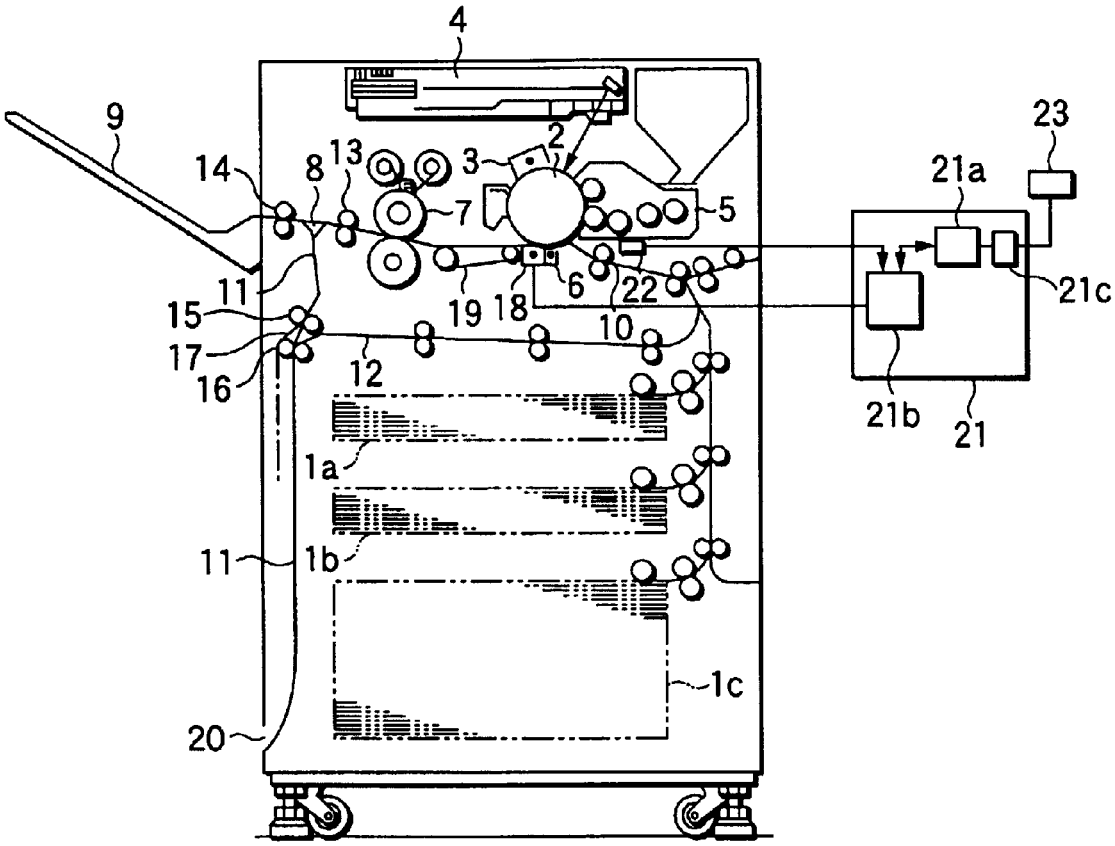
FIG. 1 is a diagram showing the whole configuration of an example of an electrophotographic apparatus.

A first embodiment of the invention will be described with reference to the accompanying drawings. FIG. 1 is a diagram showing the whole configuration of an example of a laser printer to which the invention is applied.

In FIG. 1, reference 1*a*, 1*b*, and 1*c* denote sheet feeding sections which accommodate paper sheets serving as recording members. The reference numeral 2 denotes a photosensitive drum which functions as an image carrier, and which begins to be rotated on the basis of a signal from a controller that is not shown. When the rotation of the photosensitive drum 2 is started, the surface of the photosensitive drum 2 is uniformly charged by a corona charger 3. An electrostatic latent image is formed on the charged photosensitive drum 2 by a scanning beam emitted from an exposing device 4. When the electrostatic latent image reaches the position of a developing device 5, the image is developed by a toner to be visualized as a toner image on the photosensitive drum 2.

On the other hand, a sheet is sent out from a selected one of the sheet feeding sections 1*a*, 1*b*, and 1*c* at a timing when the toner image formed on the photosensitive drum 2 can be opposed to the sheet at the position of a transferring device 6, and the toner image is then transferred to the sheet. The reference numeral 7 denotes a fixing device which fixes the toner image transferred to the sheet, 8 denotes a flap which controls the sheet transportation direction, and 9 denotes a sheet discharge tray on which sheets that have undergone the image forming process are to be stacked.

The reference numeral 10 denotes a sheet transporting path which communicates with the sheet feeding sections 1*a*, 1*b* and 1*c*, the image forming means 2, 3, 4, 5, 6, and 7, and the sheet discharge tray 9, and 11 denotes a draw-in path which branches off from the sheet transporting path 10 downstream in the sheet transporting direction from the image forming means. A sheet sent from the fixing device 7 is selectively drawn into the draw-in path in accordance with a switching control of the flap 8. The reference numeral 12 denotes a return path which branches off from an intermediate portion of the draw-in path 11, and in which the terminal end joins the sheet transporting path 10 upstream in the sheet transporting direction from the image forming means.

When printing is to be performed on both the faces of a sheet, the sheet sent from the fixing device 7 is drawn into the draw-in path 11, and the drawn-in sheet is sent out to the return path 12 to again feed the single-face recorded sheet to the image forming means, thereby enabling the double-face printing to be performed. In FIG. 1, reference numeral 13 and 14 denote transporting roller pairs which are disposed in front and rear of the flap 8, respectively, 15 and 16 denote transporting roller pairs which are disposed on the draw-in path 11 so as to be switchable from forward rotation to reverse rotation or vice versa, respectively, 17 denotes a flap which changeovers the route of the sheet drawn into the draw-in path 11 between feeding to the return path 12 and returning to the sheet transporting path 10 to discharge the sheet onto the sheet discharge tray 9, 18 denotes a separating device which separates the sheet that has passed over the transferring device 6, from the photosensitive drum 2, 19 denotes a transporting belt device which transports the sheet toward the fixing device 7, and 20 denotes a discharge port which is disposed in a lower portion of the main unit of the laser printer as an aperture having a size that allows the sheet to pass therethrough, and which is connected to the draw-in path 11.

A control section 21 which controls the separating device 18 comprises: a data section 21*a* which stores matrix data that will be described later; and a checking section 21*b* which checks the data section 21*a* with a measurement value of a temperature and humidity sensor 22 which measures the temperature and humidity of the interior of the apparatus. The separating device 18 is controlled on the basis of an output of the checking section 21*b*. A counter 23 which counts the number of revolutions of the photosensitive drum 2 is connected to the data section 21*a*.

Figure 2:
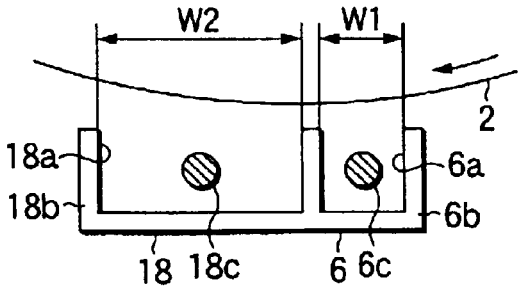
FIG. 2 is an enlarged view showing a transferring device and a separating device.

In the invention, as shown in FIG. 2, each of the transferring device 6 and the separating device 18 is configured by a corona discharger comprising: a shielding section 6*b* or 18*b* that has an aperture 6*a* or 18*a* in a part; and a corona discharge wire 6*c* or 18*c* that is supported by the shielding section 6*b* or 18*b*. FIG. 2 shows an example in which the shielding section 6*b* of the transferring device 6, and the shielding section 18*b* of the separating device 18 are integrally disposed. The invention is not restricted to this configuration. The shielding sections may be independently disposed. The separating device 18 releases charges which are opposite in polarity to those released from the transferring device 6.

In the invention, a transfer flow-in current which flows from the transferring device 6 into the photosensitive drum 2, a separation flow-in current which flows from the separating device 18 into the photosensitive drum 2, the aperture width W1 in the sheet transporting direction of the aperture 6*a* of the transferring device, and the aperture width W2 in the sheet transporting direction of the aperture 18*a* of the separating device are set to have the following relationship:

separation flow-in current=transfer flow-in current×(transfer aperture width/separation aperture width).

Figure 9:
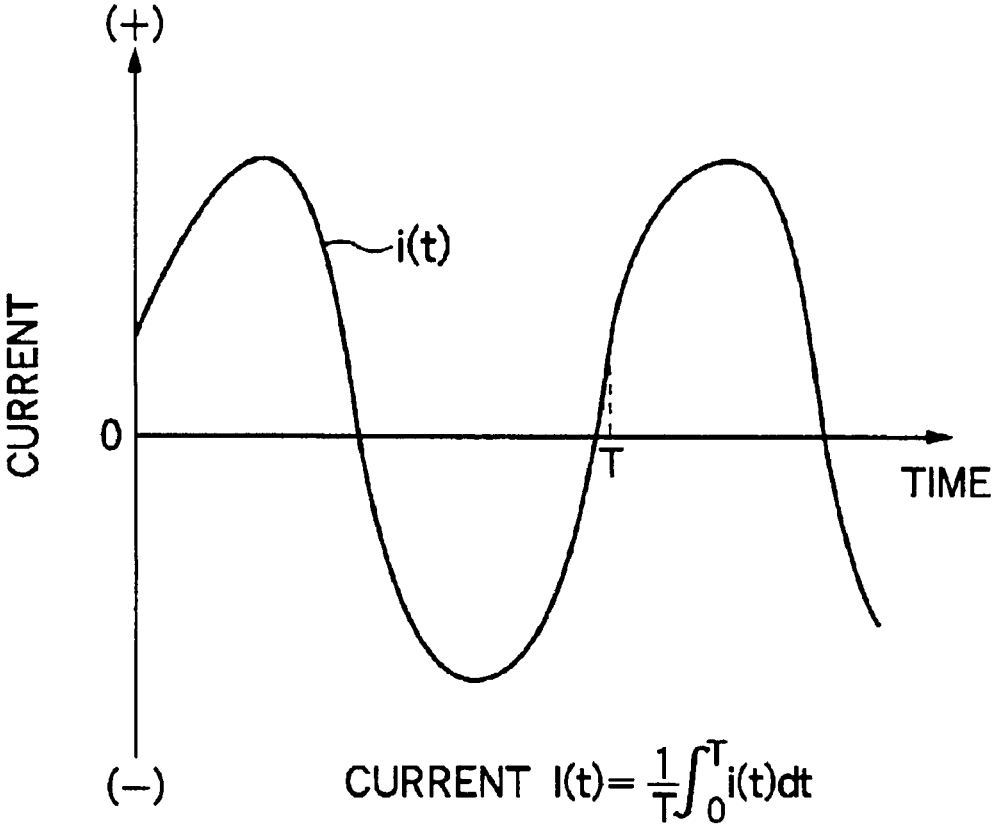
FIG. 9 is a diagram relating to the definition of a current in the invention.

In the following description, a ratio (W1/W2) of the transfer aperture width W1 to the separation aperture width W2 is defined as an aperture width ratio X. In the description of the invention, a current is defined by Ex. (1) in which a current value is integrated over one period and the integration is divided by the one period. FIG. 9 shows a relationship between the current I(t) and i(t).

$$I(t)=1/T\int^{T}_{0}i(t)dt \tag{1}$$

The total amount Qt of charges which are given to a sheet by the transferring device 6 is proportional to a product of the transfer aperture width W1 and the transfer flow-in current. Similarly, the total amount Qd of charges which are given to a sheet by the separating device 18 is proportional to a product of the separation aperture width W2 and the separation flow-in current. When the ideal condition of transfer and separation or Qt=Qd is applied, therefore, following Ex. (2) holds for the transfer flow-in current and the separation flow-in current:

(separation flow-in current)=(aperture width ratio $X$)×(transfer flow-in current) (2)

In the transferring device 6 and the separating device 18 of the embodiment, the current value is previously set to a value at which Ex. (2) holds in an environment of a temperature of 30° C. and a humidity of 60% RH. The reference current value is set with respect to the same temperature and humidity as those for a reference value of a temperature and humidity matrix which will be described later. Alternatively, another combination of the temperature and the humidity may be employed.

Figure 8:
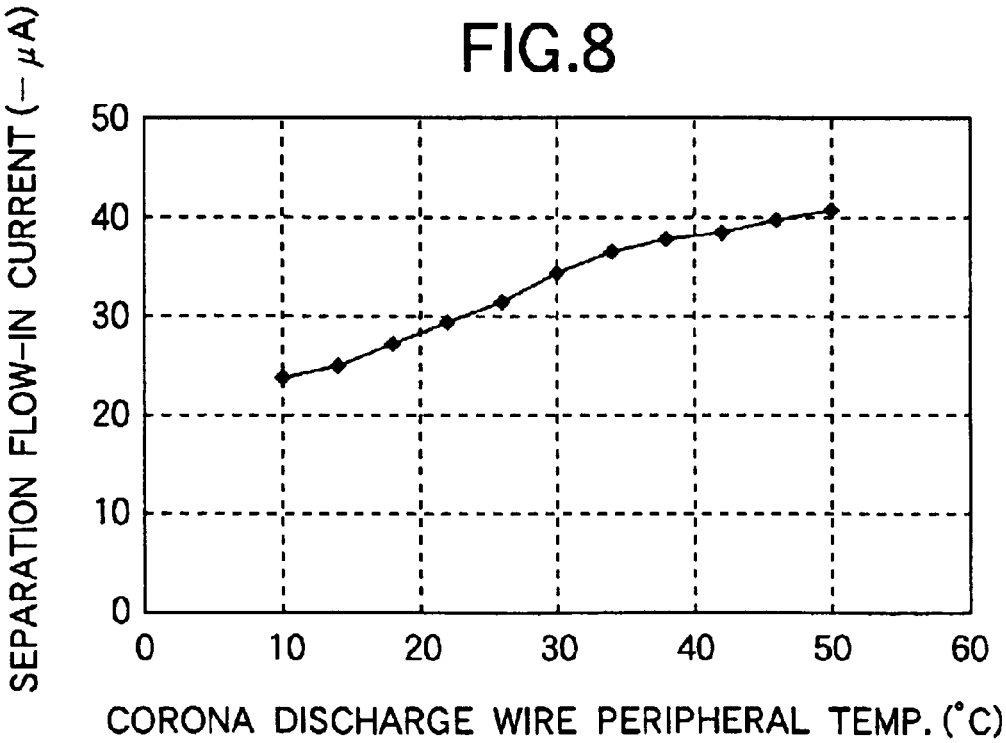
FIG. 8 is a diagram showing a relationship between the separation flow-in current and the temperature at the periphery of a wire.

Next, the factors of variation of the transfer flow-in current and the separation flow-in current will be described. The transfer flow-in current and the separation flow-in current are varied depending on the kind and ream weight of a sheet which is used in printing, or environmental conditions (the percentage of water absorption of the sheet, the environment at the periphery of a corona discharge wire, and the like). FIG. 8 shows a relationship between the temperature at the periphery of a corona discharge wire and the separation flow-in current. The separation flow-in current has a tendency to be increased as the temperature is raised. In order to inject a constant separation flow-in current into a sheet, therefore, the set value must be changed in a direction along which the separation flow-in current is further decreased as the temperature is raised.

The separation flow-in current has the property that the value in the case of a higher humidity is larger than that in the case of a lower humidity. In this way, the separation flow-in current is largely varied with variation of the environment. Therefore, a set value at which an optimum flow-in current seems to flow into a sheet is previously known from the matrix of the temperature and the humidity.

Figures 3, 4:
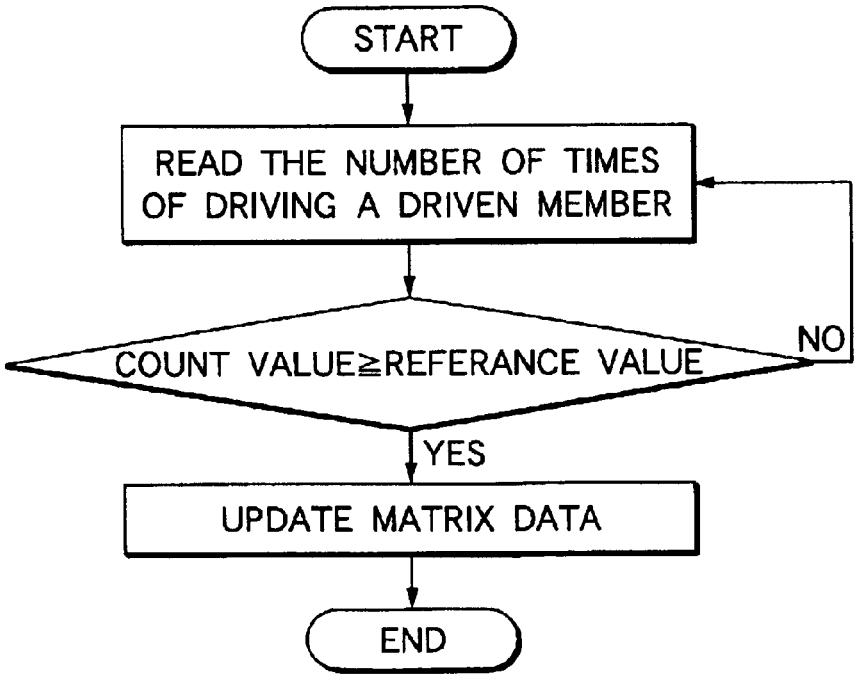
FIG. 3 is a diagram showing an example of a matrix which is used in a temperature and humidity-based control.
FIG. 4 is a flowchart relating to a control of changing a reference value of the separating device.

The temperature and humidity matrix is stored in the control section 21, and a control is performed during a printing process so that the set value is automatically updated at regular intervals on the basis of the matrix. In the embodiment, the temperature and humidity sensor 22 is attached to a portion which correlates with the temperature at the periphery of the corona discharge wire disposed in the apparatus. The temperature and the humidity are detected by the sensor 22 at predetermined time intervals. On the basis of the maximum values of the temperature and the humidity which are obtained by the sensor, the reference value is increased or decreased by a value of the corresponding position in the matrix shown in FIG. 3.

In a power source for the separating device 18 which is used in the embodiment, an AC voltage is superimposed on a DC voltage. In order to change the separation flow-in current, therefore, the DC voltage is changed. The embodiment is set so that the DC voltage is changed by about 7 to 8 V for one unit amount of change. In the temperature and humidity matrix, all the values are indicated as amounts of change with respect to the reference value in which the temperature is set to 30° C. and the humidity to 60% RH. When the temperature is 35° C. and the humidity is 60% RH, for example, a decrease of −6 is conducted on the basis of the matrix of FIG. 3. When the temperature at the periphery of the corona discharge wire is raised, the separation flow-in current is increased so as to flow into a sheet in a larger amount. Therefore, the voltage is shifted to the decreasing direction with respect to the reference value.

Figure 5:
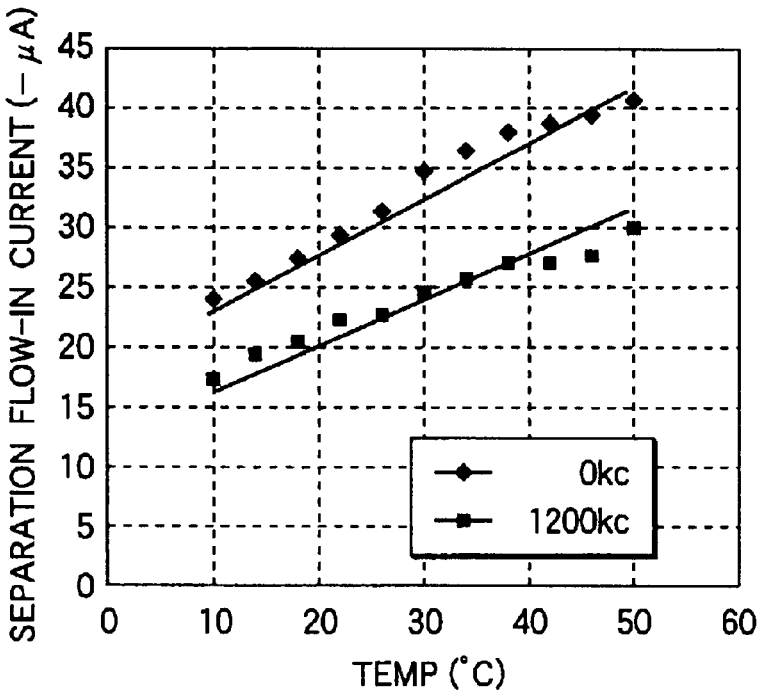
FIG. 5 is a diagram showing a relationship between the temperature and a separation flow-in current.

Next, a recording member transportation failure due to deterioration of a corona discharge wire will be described with reference to FIG. 5. FIG. 5 shows changes of the flow-in current due to the temperature, in the separating device 18 after the use of 0 kc or 1,200 kc under a constant environment. In the above, "kc" means the number of revolutions of the photosensitive drum 2.

The corona discharge wire of the separating device 18 has a tendency that, as the number of printed sheets increases, the flow-in current is decreased with elapsing time by contamination of the wire surface by the toner, or wear of the wire surface by a cleaning mechanism. Even when the temperature and the humidity are controlled, therefore, a recording member transportation failure tends to easily occur as the number of printed sheets increases.

In the decreasing tendency of the separation flow-in current due to deterioration of the corona discharge wire, the decrementation is substantially constant at any temperature. When the separation flow-in current serving as the reference is once changed, therefore, the above-mentioned temperature and humidity matrix can be then used. In the embodiment, the counter 23 disposed in the apparatus counts the number of revolutions of the photosensitive drum 2, a comparator 21*c* in the control section 21 compares the count value with the preset reference value, so that the degree of deterioration of the corona discharge wire is presumed, and the value of the temperature and humidity matrix in the data section 21*a* is changed on the basis of an output of the comparator 21*c*. As shown in a flowchart of FIG. 4, for example, the change of the reference current value of the temperature and humidity matrix is divided into a first stage from 0 kc to less than 1,200 kc, and a second stage of 1,200 kc or more, and the reference current in the first stage is set to a value which enables at 0 kc an optimum flow-in current to be injected into a sheet. In the second stage, the amount of the current which seems to be decreased by deterioration of the corona discharge wire is previously grasped, and the set value is changed to a value which compensates the decreased amount, thereby causing a sheet transportation failure due to deterioration of the wire to less occur.

In the above, the switching of two stages has been described. It is a matter of course that the accuracy can be further enhanced by changing more finely the reference current value. In the embodiment, the number of revolutions of the photosensitive drum 2 is used as the information for knowing deterioration of the corona discharge wire of the separating device. Alternatively, for example, the number of operations of cleaning the corona discharge wire may be counted, and a similar control may be conducted on the basis of the counted number. Also in the alternative, the same effects can be attained.

(Second Embodiment)

Next, a second embodiment of the invention will be described. The embodiment is characterized in that the aperture width ratio X is set to $0.25 \leqq X \leqq 0.6$. First, the manner in which a recording member transportation failure is changed depending on the size relationship between the separation aperture width W2 and the transfer aperture width W1 will be described with reference to FIG. 6.

Figure 6:
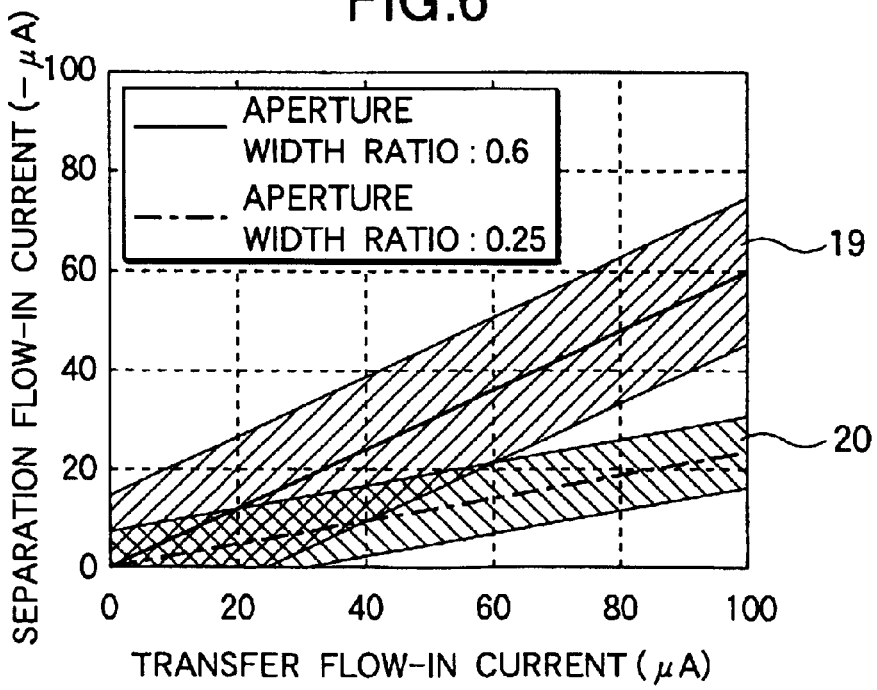
FIG. 6 is a diagram showing a relationship between a transfer flow-in current and the separation flow-in current.
Figure 7:
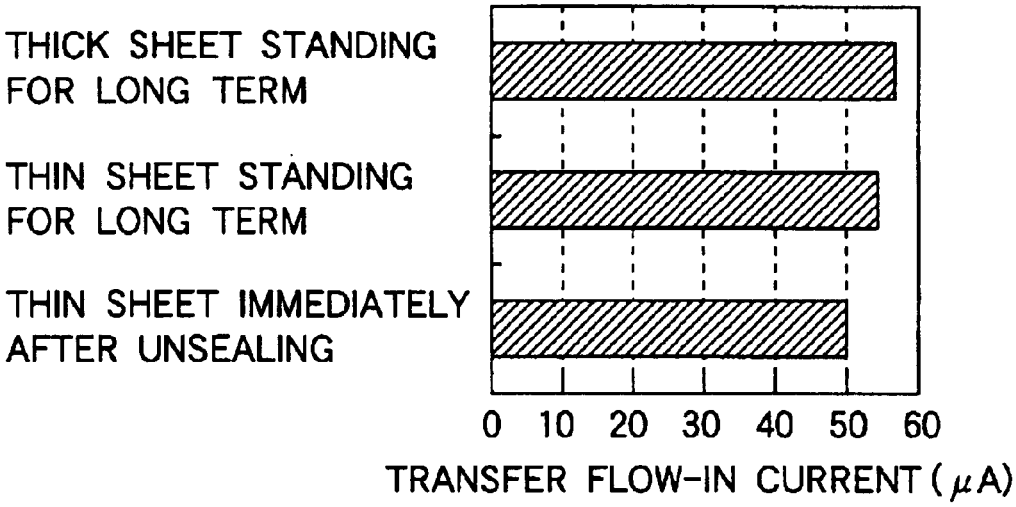
FIG. 7 is a diagram showing a relationship between the kind of a sheet and the transfer flow-in current.

The total amount Qt of charges which are given to a sheet by the transferring device 6 is proportional to a product of the transfer aperture width and the transfer flow-in current. Similarly, the total amount Qd of charges which are given to a sheet by the separating device 18 is proportional to a product of the separation aperture width and the separation flow-in current. As described above, the ideal condition of transfer and separation is that charges which are equal in amount and opposite in polarity to those flown into the sheet by the transferring device 6 are given to the sheet by the separating device 18. Therefore, the ideal relationship between the transfer flow-in current and the separation flow-in current is expressed by Ex. (2) above. The solid and single-dashed linear lines in FIG. 6 are linear lines which satisfy this relationship. When the transfer flow-in current and the separation flow-in current are varied on the corresponding one of the linear lines, a recording member transportation failure does not occur.

However, a recording member has rigidity and own weight. Even when the absolute value of charges due to transferring is not equal to that of charges due to separation, therefore, there are some cases where a recording member transportation failure does not occur. When a thick sheet or a recording member of high rigidity is transported, particularly, a phenomenon that it is wound around the photosensitive drum 2 less occurs. In FIG. 6, regions where a recording member transportation failure does not occur because of the rigidity of a recording member or the like are indicated by numerals 19 and 20, respectively. The region 19 is a region where a sheet transportation failure does not occur when a sheet is transported while using the transferring device 6 and the separating device 18 in which the aperture width ratio X is 0.6. The region 20 shows results in the case where the transferring device 6 and the separating device 18 in which the aperture width ratio X is 0.25 are used. When the regions 19 and 20 where a sheet transportation failure does not occur are expressed by an expression, Ex. (3) below is attained:

(|transfer flow-in current|×(transfer aperture width/separation aperture width)−25 μA×(transfer aperture width/separation aperture width))≦|separation flow-in current|≦(|transfer flow-in current|×(transfer aperture width/separation aperture width)+25 μA×(transfer aperture width/separation aperture width)) . . . (3)

In Ex. (3), the value "25 μA" is a current value which is varied depending on the kind of a recording member to be used in printing. In the case where a sheet thicker than the sheet used in the embodiment, for example, the current value is 33 μA, and the range where a sheet transportation failure does not occur proceeds to be widened. By contrast, the narrowest range where the sheet transportation is enabled corresponds to the state where "25 μA" in Ex. (3) becomes "0 μA", i.e., the linear lines satisfying Ex. (2). In the embodiment, experiments were conducted by using sheets which are relatively thin and have low rigidity, and the current value of Ex. (3) was then calculated.

It will be seen that the range where the sheet transportation is enabled is changed by changing the aperture widths of the transferring device 6 and the separating device 18. When the aperture width ratio X is small, the variable range of the separation flow-in current is narrowed, and a sheet transportation failure easily occurs. As shown in FIG. 8, with respect to a corona discharge wire, the separation flow-in current is changed depending on the peripheral temperature of the wire. Therefore, the sheet transportation is further hardly conducted.

By contrast, when the aperture width ratio X is large, the variable range of the separation flow-in current is widened, but a large current abruptly flows into a sheet because the separation aperture width is narrowed. Therefore, a phenomenon that an unfixed toner image is disturbed. In order to prevent an unfixed toner image from being disturbed, consequently, the aperture width ratio of 0.6 or less is required.

In the case where the temperature and humidity-based control is not used, it is known from FIG. 8 that the variable range of the separation flow-in current is about 16 μA with respect to a change from 10 to 50° C. in the temperature of the periphery of the wire. From FIG. 6, therefore, the aperture width ratio at which the variable range of the separation flow-in current is allowed to 16 μA is 0.25 or more. As a result, the optimum aperture width ratio at which the separation flow-in current is provided with variation tolerance and an unfixed toner image is not disturbed is $0.25 \leqq X \leqq 0.6$.

When a transferring device and a separating device which have an aperture width as defined in the embodiment are used and the temperature and humidity-based control shown in the first embodiment is employed, more stable sheet transportation is realized.

As described above, according to the invention, it is possible to provide an electrophotographic apparatus in which, irrespective of deterioration of a corona discharge wire, stable separation and transportation of a recording member can be realized for a long term.

What is claimed is:

1. An electrophotographic apparatus, comprising:

a transferring device comprising a corona discharger including a shielding section that includes an aperture, and a corona discharge wire that is supported by said shielding section, said transferring device transferring a toner image formed on an image carrier to a recording member; and a separating device comprising a corona discharger including a shielding section that includes an aperture, and a corona discharge wire that is supported by said shielding section, said separating device being disposed downstream in a recording member transporting direction from said transferring device, and releasing charges of a polarity opposite to a polarity of charges released from said transferring device, wherein a transfer flow-in current which flows from said transferring device into said image carrier, a separation flow-in current which flows from said separating device into said image carrier, an aperture width in the recording member transporting direction of said aperture of said transferring device, and an aperture width in the recording member transporting direction of said aperture of said separating device to satisfy:

separation flow-in current=transfer flow-in current×(transfer aperture width/separation aperture width).

2. The electrophotographic apparatus according to claim 1, further comprising:

a controller for, during a printing process, controlling the separation flow-in current to satisfy:

(|transfer flow-in current|(transfer aperture width/separation aperture width)−25 μA×(transfer aperture width/separation aperture width)≦|separation flow-in current|≦(|transfer flow-in current|×(transfer aperture width/separation aperture width)+25 μA×(transfer aperture width/separation aperture width)).

3. The electrophotographic apparatus according to claim 2, wherein said controller further comprises:

a detector which detects a temperature and a humidity of an interior of a main unit of said apparatus;

a checking section for checking an output value of said detector with a pre-set matrix data;

a set-value changing section for changing a set value of the separation flow-in current on the basis of a result of the checking by said checking section; and a data updating section for updating the matrix data of said checking section based upon information indicative of deterioration of said corona discharge wire of said separating device.

4. The electrophotographic apparatus according to claim 3, wherein said controller includes a counter which counts a number of operations of driving a driven member, and uses an output value of said counter as the information indicative of the deterioration of said corona discharge wire of said separating device.

5. The electrophotographic apparatus according to claim 4, wherein said driven member comprises said image carrier, and wherein said counter counts a number of revolutions of said image carrier, and a count value of said counter is used as the information indicative of the deterioration of said corona discharge wire of said separating device.

6. The electrophotographic apparatus according to claim 2, wherein said controller performs reading of a temperature and a humidity at predetermined time intervals, and updates a set value of the separation flow-in current.

7. The electrophotographic apparatus according to claim 6, wherein the updates of the set value of the separation flow-in current are performed based upon maximum values of the temperature and the humidity which are read for a predetermined time period.

8. The electrophotographic apparatus according to claim 1, wherein a ratio X (=transfer aperture width/separation aperture width) of the transfer aperture width to the separation aperture width is set to $0.25 \leqq X \leqq 0.60$.

9. An electrophotographic apparatus, comprising:

a main body;

a transferring device which transfers a toner image formed on an image carrier to a recording member;

a separating device which is disposed downstream in a recording member transporting direction from said transferring device;

a detector which detects at least one of a temperature and a humidity of an interior of said main body;

a data section which stores prior reference data that is set on the basis of information of at least one of the temperature and the humidity;

a checking section for checking a detection value of said detector with the reference data of said data section, and for controlling a current of said separating device;

a counter in which a driven member in said electrophotographic apparatus is set as a measurement object, and which counts a number of driven rotations of said driven member; and an updating section for updating the reference data of said data section on the basis of an output of said counter.

10. An electrophotographic apparatus, comprising:

a transferring device which transfers a toner image formed on an image carrier to a recording member;

a separating device, disposed downstream of said transferring device, which separates said recording member from said image carrier; and a controller, operatively connected to said separating device, for controlling a separation flow-in current to said separating device according to an environmental factor.

11. The electrophotographic apparatus of claim 10, further comprising:

a temperature sensor, operatively attached to said controller, wherein said controller controls said separation flow-in current according to a temperature sensed by said temperature sensor.

12. The electrophotographic apparatus of claim 10, further comprising:

a humidity sensor attached to said controller, wherein said controller controls said separation flow-in current according to a humidity sensed by said humidity sensor.

13. The electrophotographic apparatus of claim 10, wherein said controller updates said separation flow-in current according to a predetermined comparison matrix of a value for said environmental factor and a value for said separation flow-in current.

14. The electrophotographic apparatus of claim 10, further comprising:

a temperature sensor, positioned adjacent to said separating device, which measures a temperature at said separating device, wherein if the temperature measured by said temperature sensor changes, said controller changes the separation flow-in current to said recording member.

15. The electrophotographic apparatus of claim 10, further comprising:

a controller, operatively connected to said apparatus; and a corona discharge wire connected to said transferring device, wherein said controller controls said separation flow-in current according to an age of said corona discharge wire.

16. The electrophotographic apparatus of claim 10, further comprising:

a counter, operatively connected to said controller, which counts a number of cleaning operations performed on said transferring device and tracks said cleaning operations as a cleaning operation value, wherein said controller compares said cleaning operation value with a reference value and controls said separation flow-in current according to said comparison.

17. An electrophotographic apparatus, comprising:

a transferring device for transferring a toner image formed on an image carrier to a recording member using a transfer flow-in current, said transferring device including an aperture with a width, for receiving a recording member; and a separating device disposed downstream in a recording member transporting direction from said transferring device for separating said recording member from said image carrier using a separation flow-in current, said separating device including an aperture with a width, for receiving said recording member, wherein said separation flow-in current is a product of said transfer flow-in current, and a ratio, X, of said transfer aperture width to said separation aperture width.

18. The electrophotographic apparatus of claim 17, wherein said ratio of said transfer aperture width to said separation aperture width is set to $0.25 \leqq X \leqq 0.60$.

19. The electrophotographic apparatus of claim 17, further comprising:

a controller, operatively connected to said apparatus, for controlling said separation flow-in current according to a type of recording member.

20. The electrophotographic apparatus of claim 17, further comprising:

a controller, operatively connected to said separating device, for controlling the separation flow-in current to said separating device according to an environmental factor.

21. The electrophotographic apparatus of claim 20, further comprising:

a temperature sensor attached to said controller, wherein said controller controls said separation flow-in current according to a temperature sensed by said temperature sensor.

22. The electrophotographic apparatus of claim 20, further comprising:

a humidity sensor attached to said controller, wherein said controller controls said separation flow-in current according to a humidity sensed by said humidity sensor.

23. The electrophotographic apparatus of claim 20, wherein said controller updates said separation flow-in current according to a predetermined comparison matrix of a value for said environmental factor and a value for said separation flow-in current.

24. The electrophotographic apparatus of claim 20, further comprising:

a temperature sensor positioned adjacent to said separating device which measures a temperature at said separating device, wherein when the temperature measured by said temperatures sensor rises, said controller increases the separation flow-in current to said recording member.

25. The electrophotographic apparatus of claim 20, further comprising:

a counter, operatively connected to said controller, which counts revolutions of said image carrier and tracks said counts as a count value, wherein said controller compares said count value with a reference value and controls said separation flow-in current according to said comparison.

26. The electrophotographic apparatus of claim 20, further comprising:

a counter, operatively connected to said controller, which counts a number of cleaning operations performed on said transferring device and tracks said cleaning operations as a cleaning operation value, wherein said controller compares said cleaning operation value with a reference value and controls said separation flow-in current according to said comparison.

27. The electrophotographic apparatus of claim 10, further comprising:

a controller, operatively connected to said apparatus; and a corona discharge wire connected to said transferring device, wherein said controller controls said separation flow-in current according to an age of said corona discharge wire.

* * * * *